US006558192B1

(12) United States Patent
Kuo

(10) Patent No.: US 6,558,192 B1
(45) Date of Patent: May 6, 2003

(54) STACKED ELECTRONIC CARD CONNECTOR ASSEMBLY

(75) Inventor: Ming Lun Kuo, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/099,848

(22) Filed: Mar. 14, 2002

(30) Foreign Application Priority Data

Dec. 19, 2001 (TW) ..... 90222276 U

(51) Int. Cl.[7] ..... H01R 13/60
(52) U.S. Cl. ..... 439/541.5
(58) Field of Search ..... 439/541.5, 159, 439/160, 79, 607, 630, 701, 717, 594, 64

(56) References Cited

U.S. PATENT DOCUMENTS 5,316,488 A * 5/1994 Gardner et al. ..... 439/541.5
5,324,204 A * 6/1994 Lwee ..... 439/541.5
6,059,586 A * 5/2000 Watanabe et al. ..... 439/541.5
6,062,904 A * 5/2000 Oguchi et al. ..... 439/541.5
6,193,547 B1 * 2/2001 Tung ..... 439/541.5
6,482,030 B1 * 11/2002 Kuo ..... 439/541.5

* cited by examiner

*Primary Examiner*—Renee Luebke
*Assistant Examiner*—Felix O. Figueroa
(74) *Attorney, Agent, or Firm*—Wei Te Chung

(57) ABSTRACT

A stacked electronic card connector assembly includes a Smart Card connector including a contact module including a housing retaining first contacts and a Card Bus connector including a header retaining second contacts. An insulative frame defines an opening receiving and retaining the contact module of the Smart Card connector. The header is stacked over the housing of the Smart Card connector. The Smart Card connector has a first ejection mechanism for removing a Smart Card out of the Smart Card connector. The Card Bus connector has a second ejection mechanism for removing an electronic card out of the Card Bus connector. Shielding shells are attached and enclose the connectors. A circuit board is soldered to contacts of the connectors and grounding pins extending from the top plate. The circuit board is engageable with an electrical connector mounted to a main circuit board.

1 Claim, 12 Drawing Sheets

STACKED ELECTRONIC CARD CONNECTOR ASSEMBLY

BACKGROUND OF THE INVENTION

1. Field of the Invention

The present invention generally relates to electronic card connectors for reading/accessing electronic cards, such as memory cards, and in particular to a stacked assembly of two electronic card connectors of different types, such as a Card Bus connector and a Smart Card connector.

2. The Related Arts

Electronic card connectors have been widely used in a variety of electronic devices that require additional memory. Examples of the electronic cards are PCMCIA/Card Bus cards and Smart Cards. Each different electronic card can only be accessed by means of a unique connector. Although two PCMCIA connectors stacked together is known, such as U.S. Pat. No. 5,324,204, it is mainly for doubling the card receiving space in order to receive memory cards of different sizes. Heretofore, Card Bus connectors and Smart Card connectors are still individually mounted in for example a notebook computer. This not only increases the number of parts of the notebook computer, but also requires a great amount of space for accommodating these individual electronic card connectors.

It is thus desirable to provide a stacked assembly of a Card Bus connector and a Smart Card connector for alleviating the above-discussed problems.

SUMMARY OF THE INVENTION

Accordingly, an object of the present invention is to provide a stacked assembly of a Card Bus connector and a Smart Card connector, both of which are provided with an electronic card ejection mechanism and are well shielded for protection against electromagnetic interference.

Another object of the present invention is to provide a stacked electronic card connector assembly comprising two different electronic card connectors stacked over each other for reducing footprint of a printed circuit board that the electronic card connectors occupy.

A further object of the present invention is to provide an electronic card connector assembly, which comprises less number of parts.

To achieve the above objects, in accordance with the present invention, there is provided a stacked electronic card connector assembly comprising a Smart Card connector including a contact module having a housing retaining a number of first contacts and a Card Bus connector comprising a header retaining a number of second contacts. An insulative frame defines an opening receiving and retaining the contact module of the Smart Card connector. The header is stacked over the housing of the Smart Card connector. The Smart Card connector has a first ejection mechanism for removing a Smart Card out of the Smart Card connector. The Card Bus connector has a second ejection mechanism for removing an electronic card out of the Card Bus connector. The ejection mechanisms comprise top and bottom plates respectively positioned below the Smart Card connector and above the Card Bus connector and rocking arms rotatably supported by the bottom and top plates. Manually operable ejection bars are coupled to the rocking arms for driving the electronic cards out of the connectors. Shielding shells are attached and enclose the connectors. A circuit board is soldered to contacts of the connectors and grounding pins extending from the top plate. The circuit board is engageable with an electrical connector mounted to a main circuit board, such as a motherboard of a notebook computer, thereby electrically connecting the Smart Card connector and the Card Bus connector to the main circuit board.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
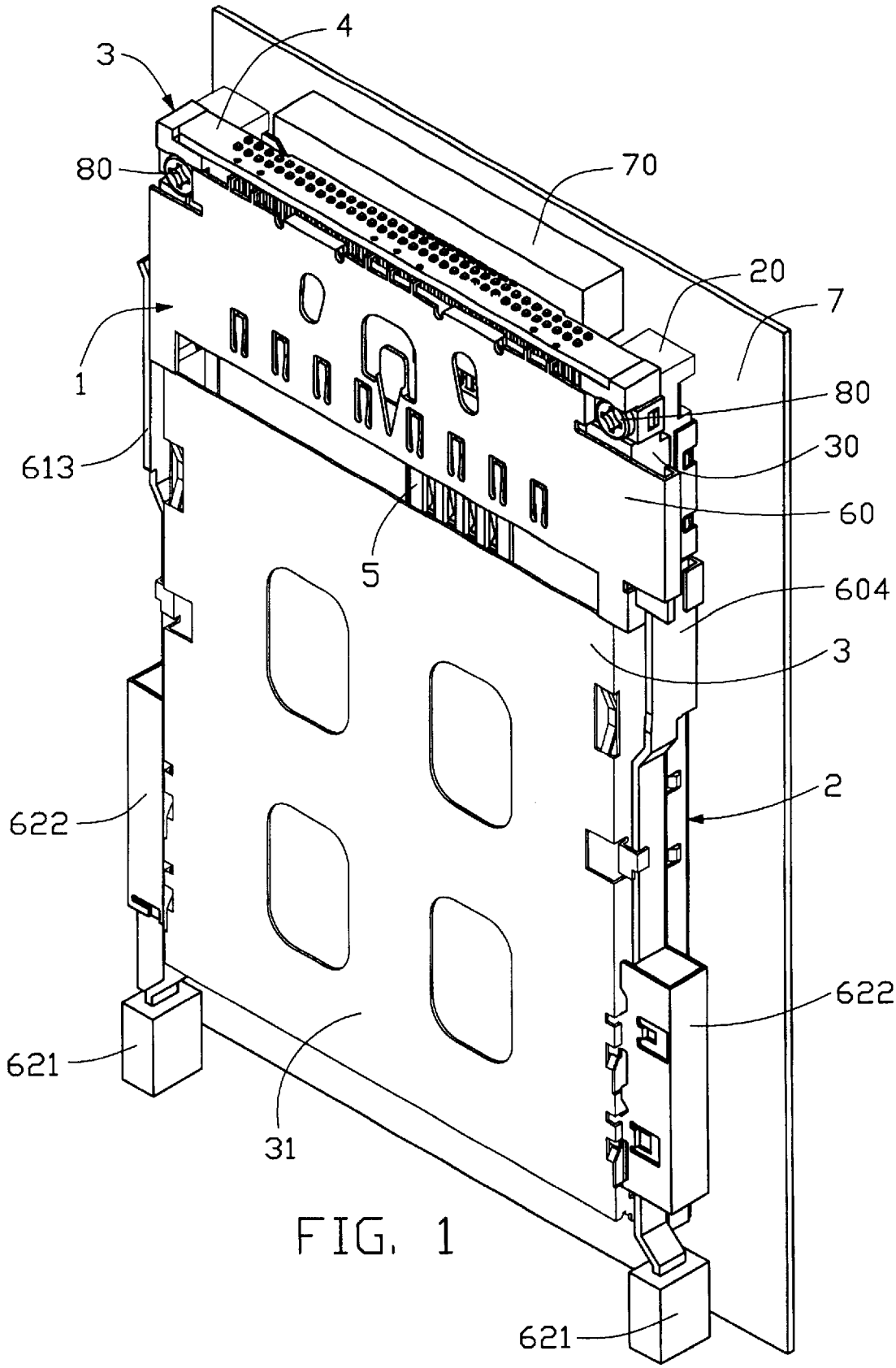
FIG. 1 is a perspective view of a stacked electronic card connector assembly constructed in accordance with the present invention mounted on a circuit board.
Figure 13:
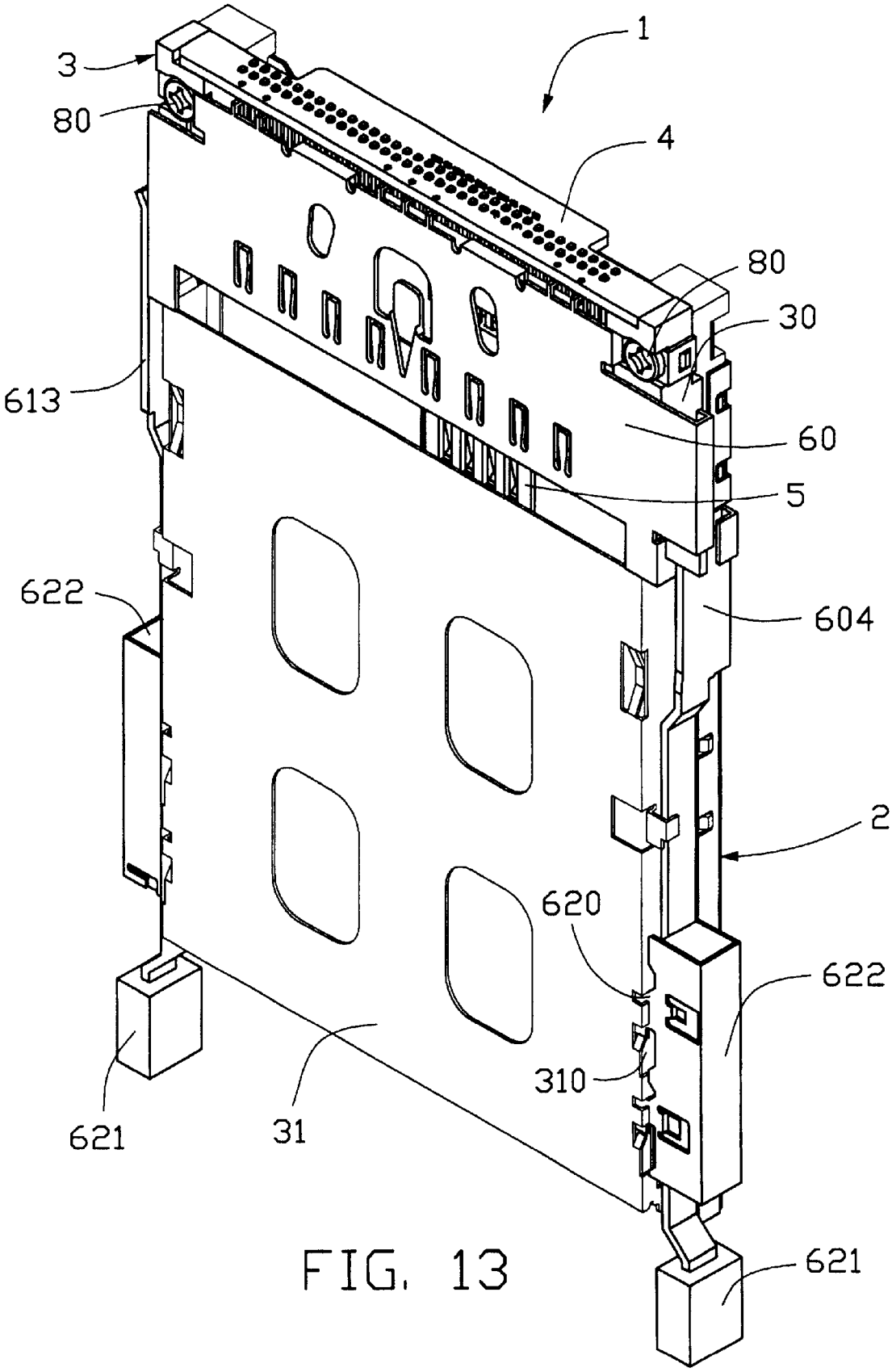
FIG. 13 is a perspective view of the stacked electronic card connector assembly of the present invention.

With reference to the drawings and in particular to FIGS. 1 and 13, a stacked electronic card connector assembly, generally designated with reference numeral 1, constructed in accordance with the present invention comprises a first electronic card connector 2 and a second electronic card connector 3 fixed to each other in a stacked fashion whereby the second electronic card connector 3 is stacked over the first electronic card connector 2. A circuit board 4 is electrically connected to both the first and second electronic card connectors 2, 3 and is releasably fit into an electrical connector 70 that is mounted on a printed circuit board 7, such as a mother board of a notebook computer (not shown), whereby an electrical connection is established between the first and second electronic card connectors 2, 3 and the printed circuit board 7.

Figure 2:
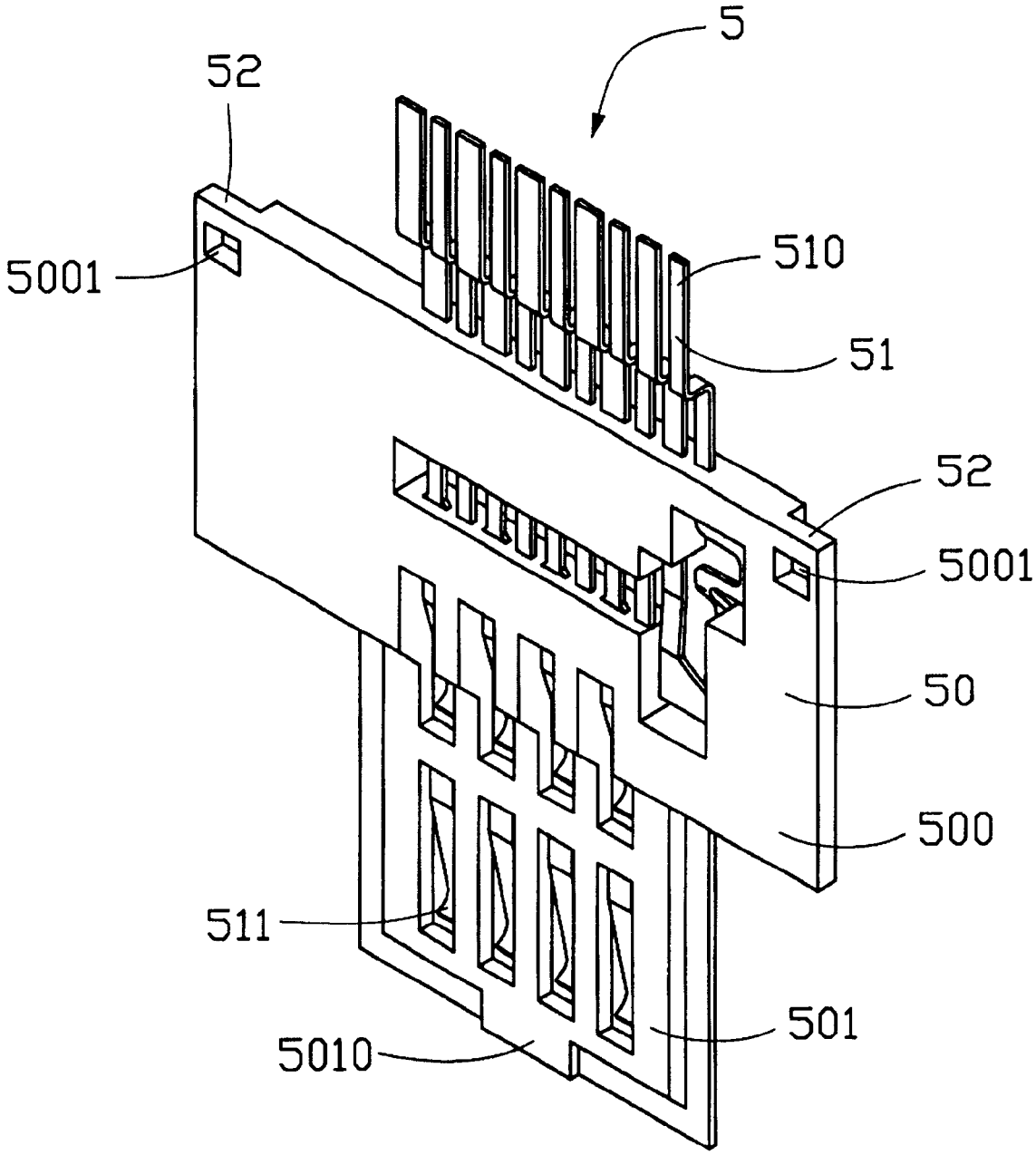
FIG. 2 is a perspective view showing a contact module of a first, Smart Card connector of the stacked electronic card connector assembly in accordance with the present invention.
Figure 6:
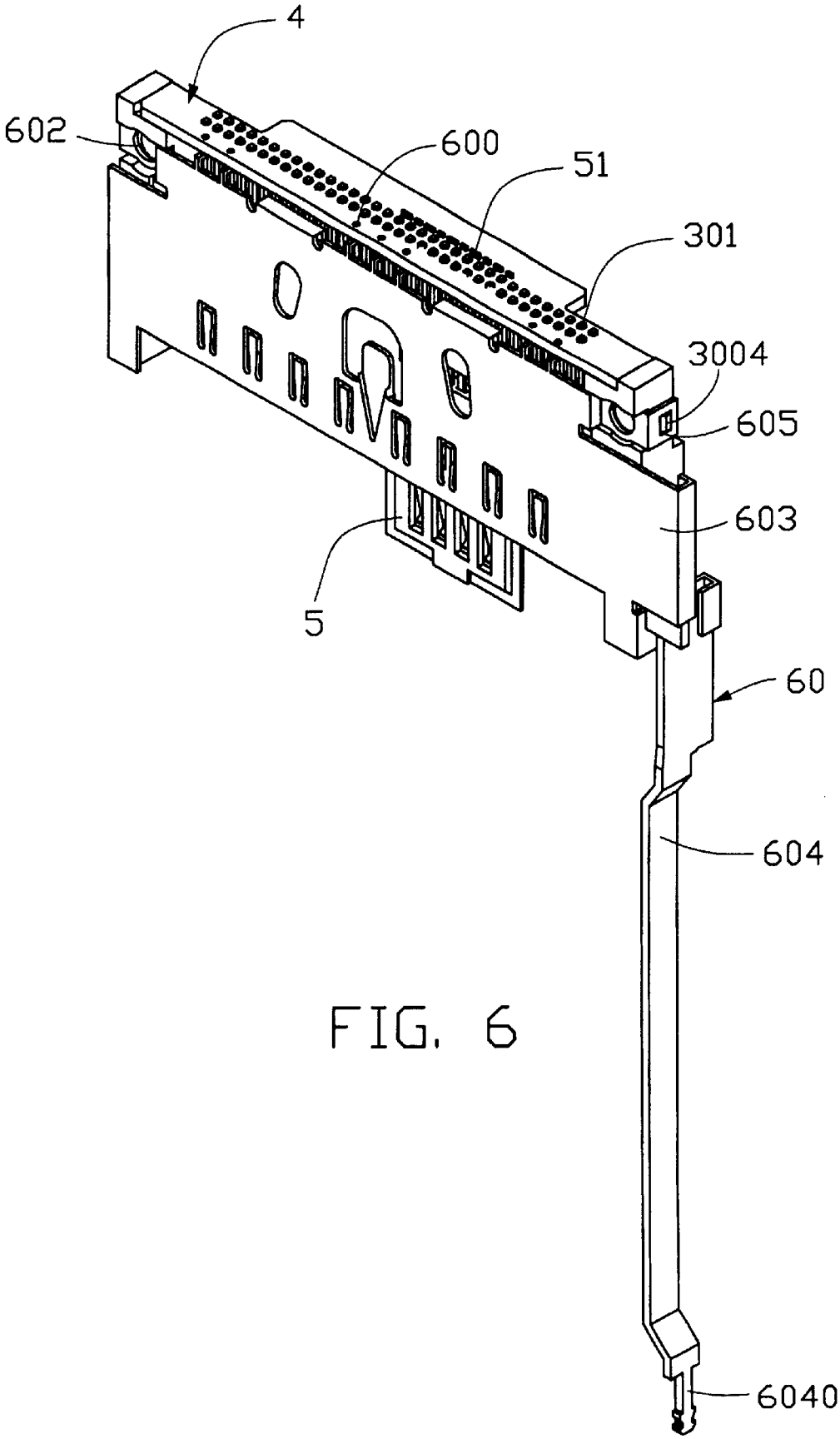
FIG. 6 is an assembled view of the header and card ejection mechanism of the Card Bus connector and the contact module of the Smart Card connector.
Figure 10:
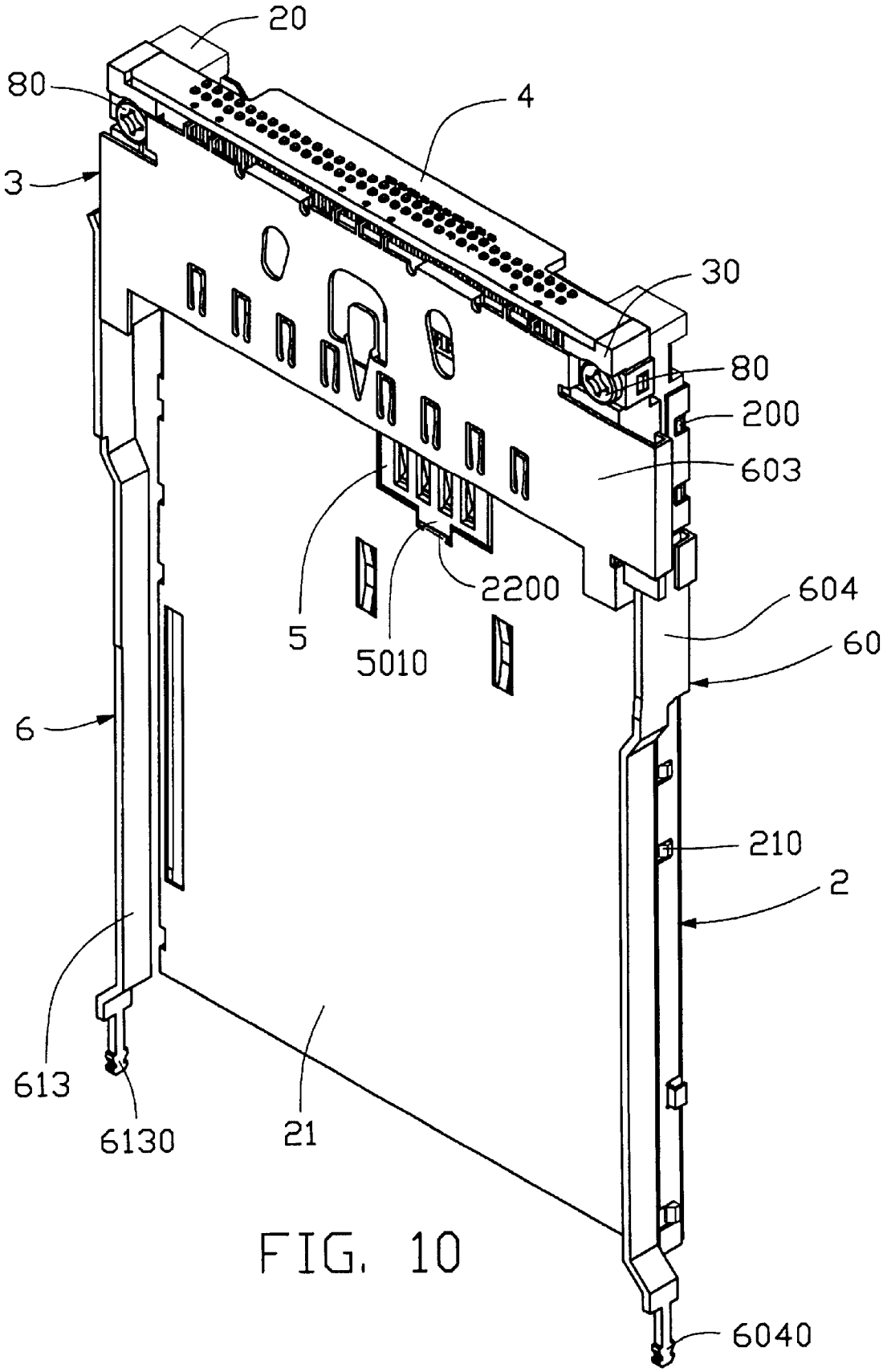
FIG. 10 is a partially assembled of the Smart Card connector and the Card bus connector with an outer shielding shell of the Card Bus connector removed.

Also referring to FIGS. 2, 6 and 10, in the embodiment illustrated, the first electronic card connector 2 is a Smart Card connector comprising a contact module 5 comprising a first insulative housing 50 having a contact retention section 500 and a card engaging section 501. A number of first conductive contacts 51 is retained in the contact retention section 500 of the first housing 50 by means of for example insert molding and each contact 51 has a tail 510 extending beyond the first housing 50 for being soldered and thus connected to the circuit board 4 (see FIG. 6). The first contacts 51 have a resilient or elastically deformable portions 511 located in slots (not labeled) defined in the card engaging section 501 of the first housing 50 for electrically engaging a Smart Card (not shown). This is well known and thus no further detail is needed herein. The contact retention section 500 of the first housing 50 forms step-like flanges 52 on opposite sides thereof. A cylindrical projection (not shown) is formed on the flange 52. A slot 5001 is defined in the flange 52.

Figure 8:
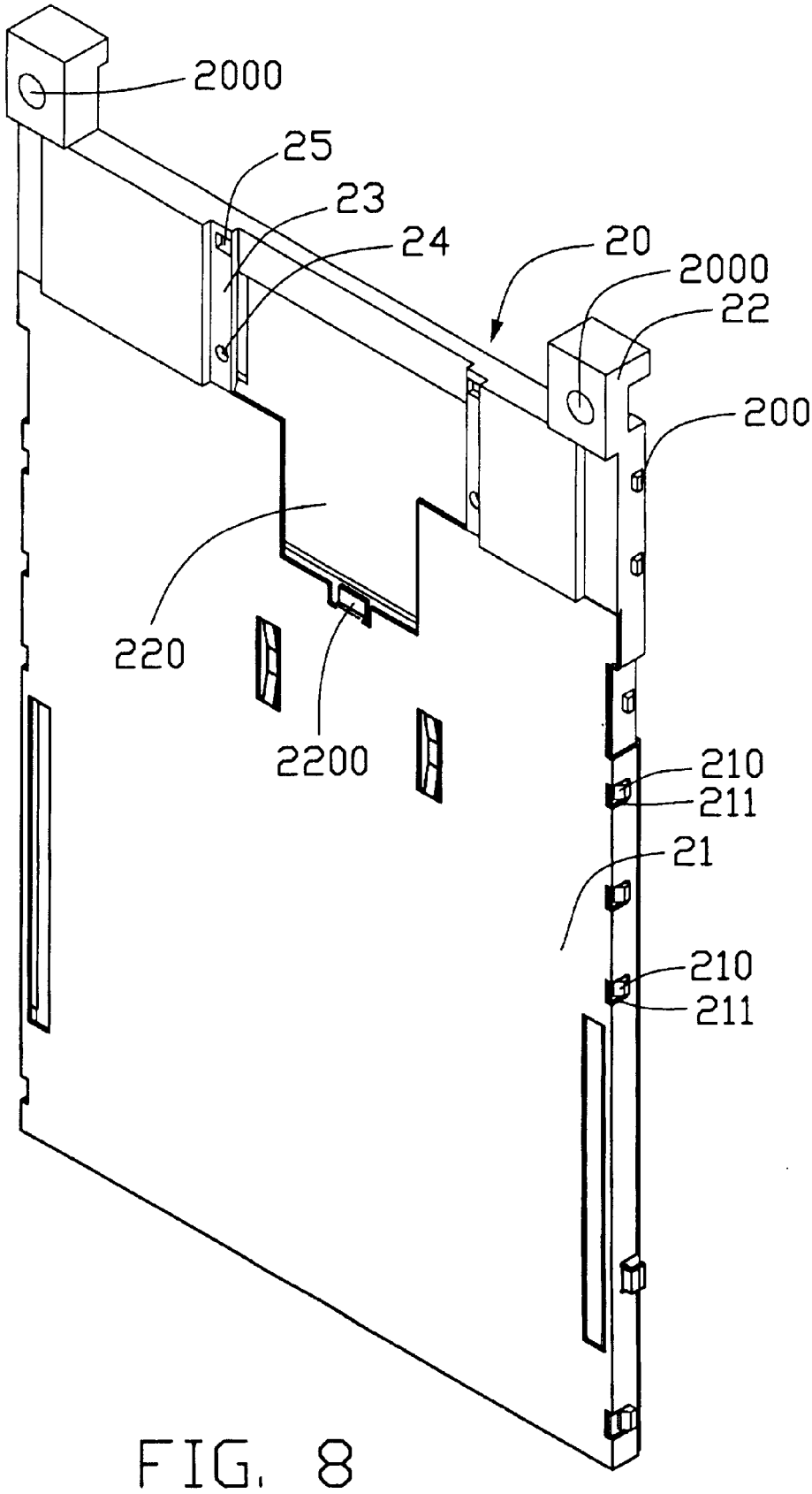
FIG. 8 is a perspective view of a retention housing and an inner shielding shell of the Smart Card connector.
Figure 9:
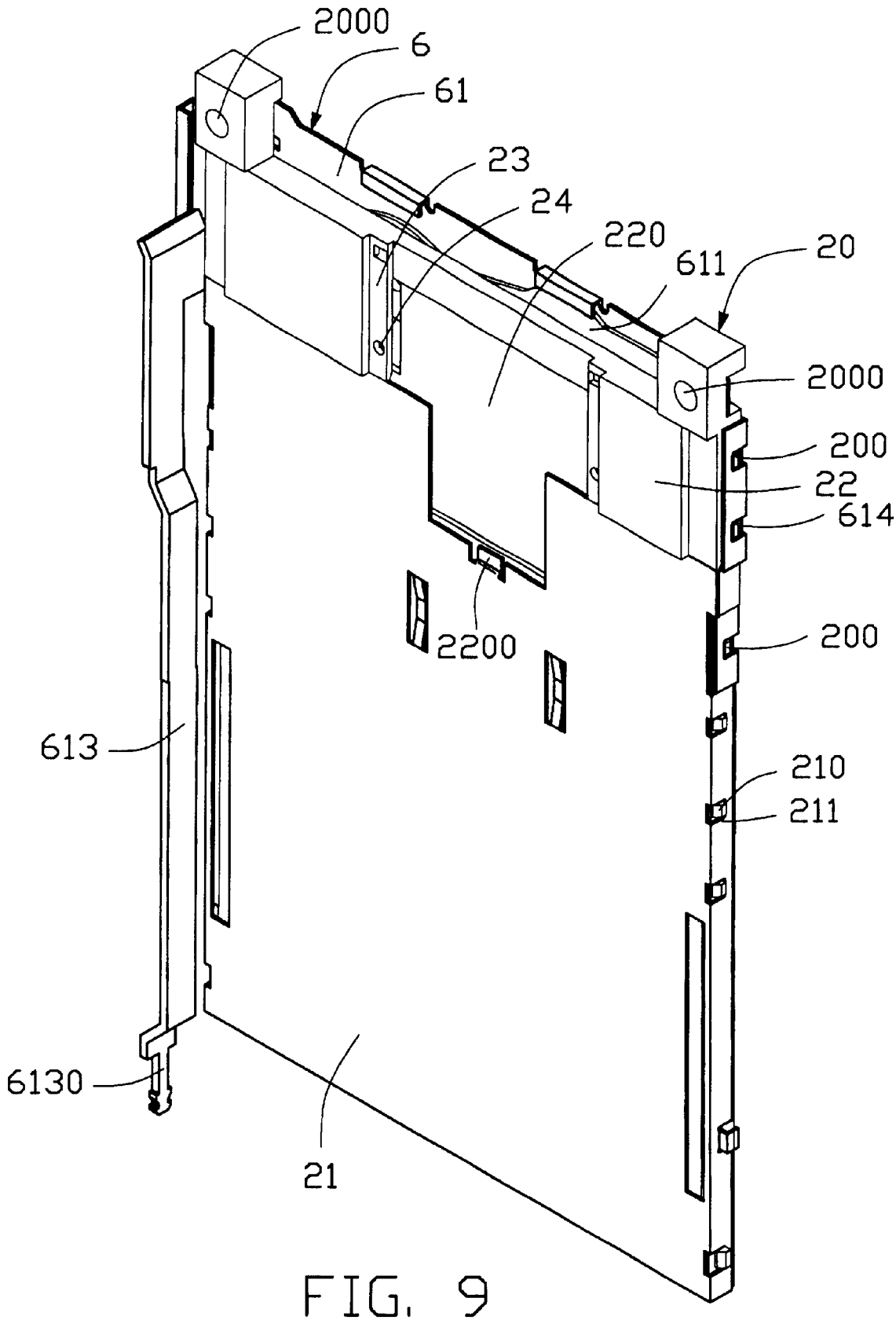
FIG. 9 is an assembled view of the retention housing and Smart Card ejection mechanism of the Smart Card connector.

Also referring to FIGS. 8 and 9, the first electronic card connector 2 also comprises a second, retention housing 20 comprises an insulative frame 22 carrying and supporting an inner shielding shell 21 made of a conductive material, such as metal. Projections 210 are formed on opposite side faces (not labeled) of the frame 22 for engaging corresponding notches 211 defined in the inner shielding shell 21 to secure the inner shielding shell 21 to the frame 22.

The frame 22 defines an interior space (not shown) for receiving a Smart Card (not shown). An opening 220 is defined in the frame 22 for accommodating the contact module 5 whereby the first contacts 51 of the contact module 5 are engageable with corresponding conductive pads of the Smart Card received in the retention housing 20. Two steps 23 are formed along opposite side walls of the opening 220 and each step 23 defines a bore 24. The contact module 5 of the first electronic card connector 2 is received in the opening 220 with the side flanges 52 positioned on and supported by the steps 23 of the opening 220. The cylindrical projections of the side flanges 52 receivingly engage the bores 24 of the steps 23 for properly positioning the contact module 5 in the frame 22. If desired, a force fit may be formed between the projections and the bores 24 for retaining the contact module 5 in the retention housing 20.

The card engaging section 501 of the first housing 50 of the first electronic card connector 2 has a raised portion 5010 in which a cavity (not shown) is defined to receivingly engage a tab 2200 of the inner shielding shell 21 for attaching the parts together and for positioning these parts with respect to each other.

Figure 7:
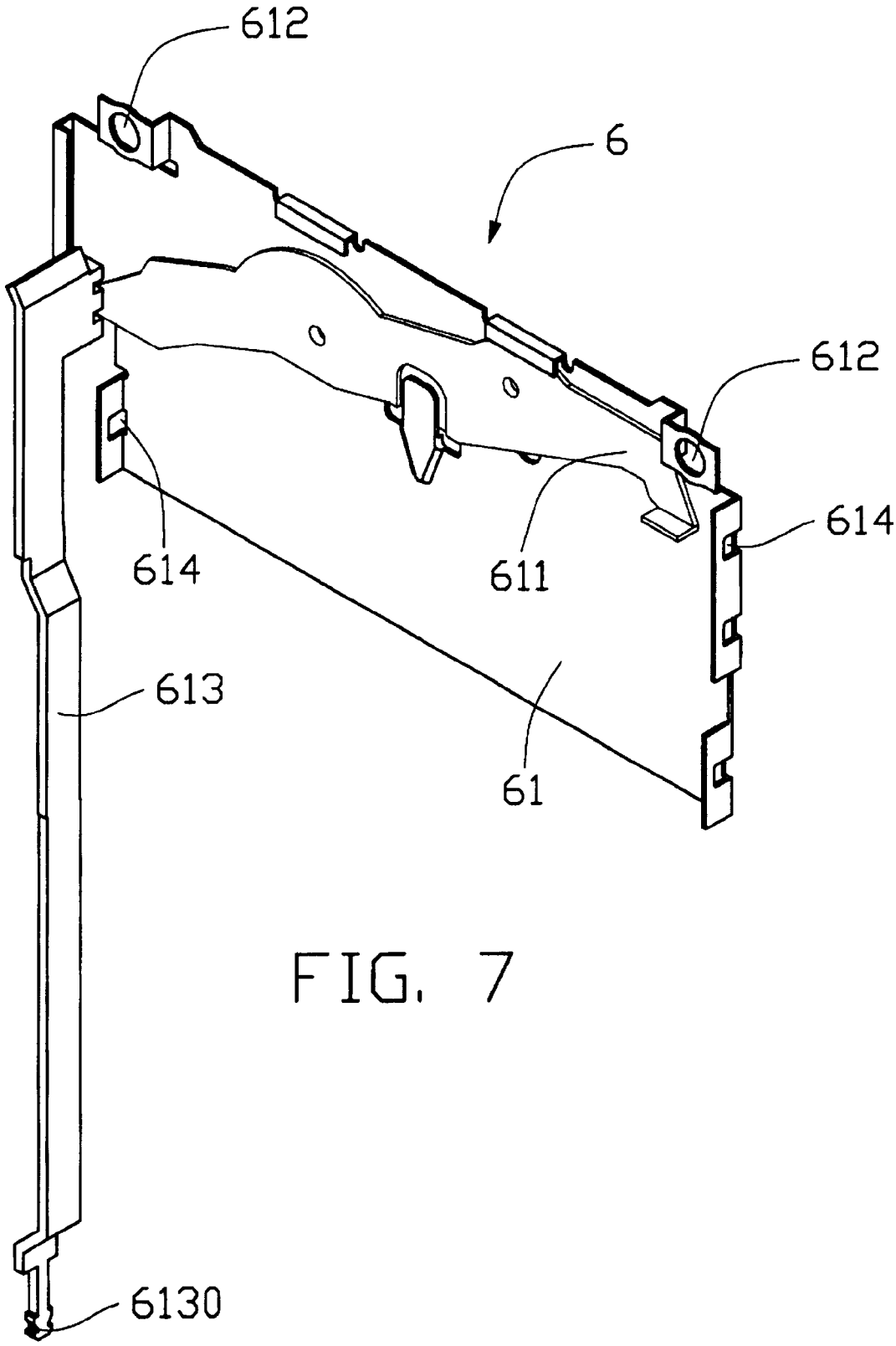
FIG. 7 is a perspective view of a Smart Card ejection mechanism of the Smart Card connector.

Also referring to FIG. 7, a first ejection mechanism 6 is attached to a bottom side of the retention housing 20 for removing the Smart Card out of the first electronic card connector 2. The first ejection mechanism 6 comprises a bottom plate 61 substantially underlapping the retention housing 20 and defining notches 614 that engage corresponding projections 200 formed along the side faces (not labeled) of the frame 22 of the retention housing 20 to attach the first ejection mechanism 6 to the retention housing 20 as shown in FIG. 9. The bottom plate 61 is preferably made conductive material, such as metal, and shielding the first contacts 51 for protection of the first electronic card connector 2 from electro-magnetic interference.

A first rocking arm 611 is rotatably mounted to the bottom plate 61 and is drivingly coupled to a first ejection bar 613. The first ejection bar 613 is manually movable with respect to the retention housing 20 for operating the first rocking arm 611 to eject the Smart Card out of the first electronic card connector 2.

Holes 612 are defined in the bottom plate 61 and are aligned to bores 2000 defined in the retention housing 20 for the extension of bolts 80. This will be further discussed.

Figure 3:
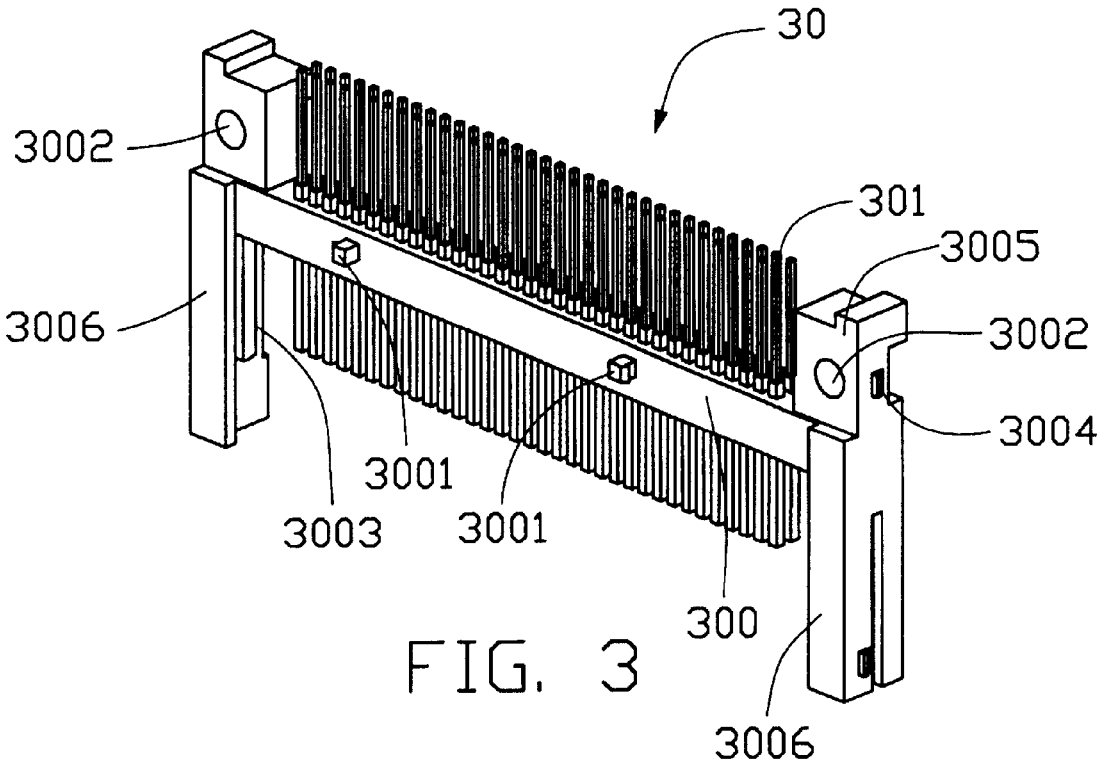
FIG. 3 is a perspective view of a header of a second, Card Bus connector.
Figure 4:
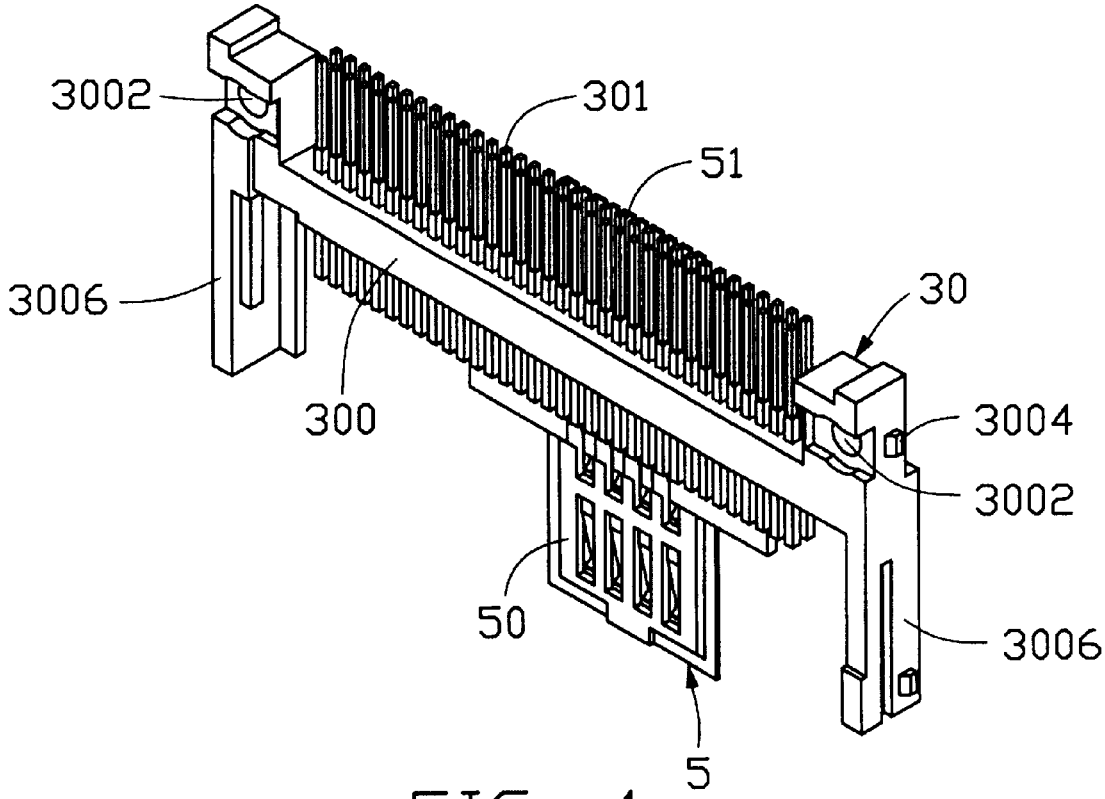
FIG. 4 is another perspective view of the header of the Card Bus connector with the contact module of the Smart Card connector mounted thereto.
Figure 5:
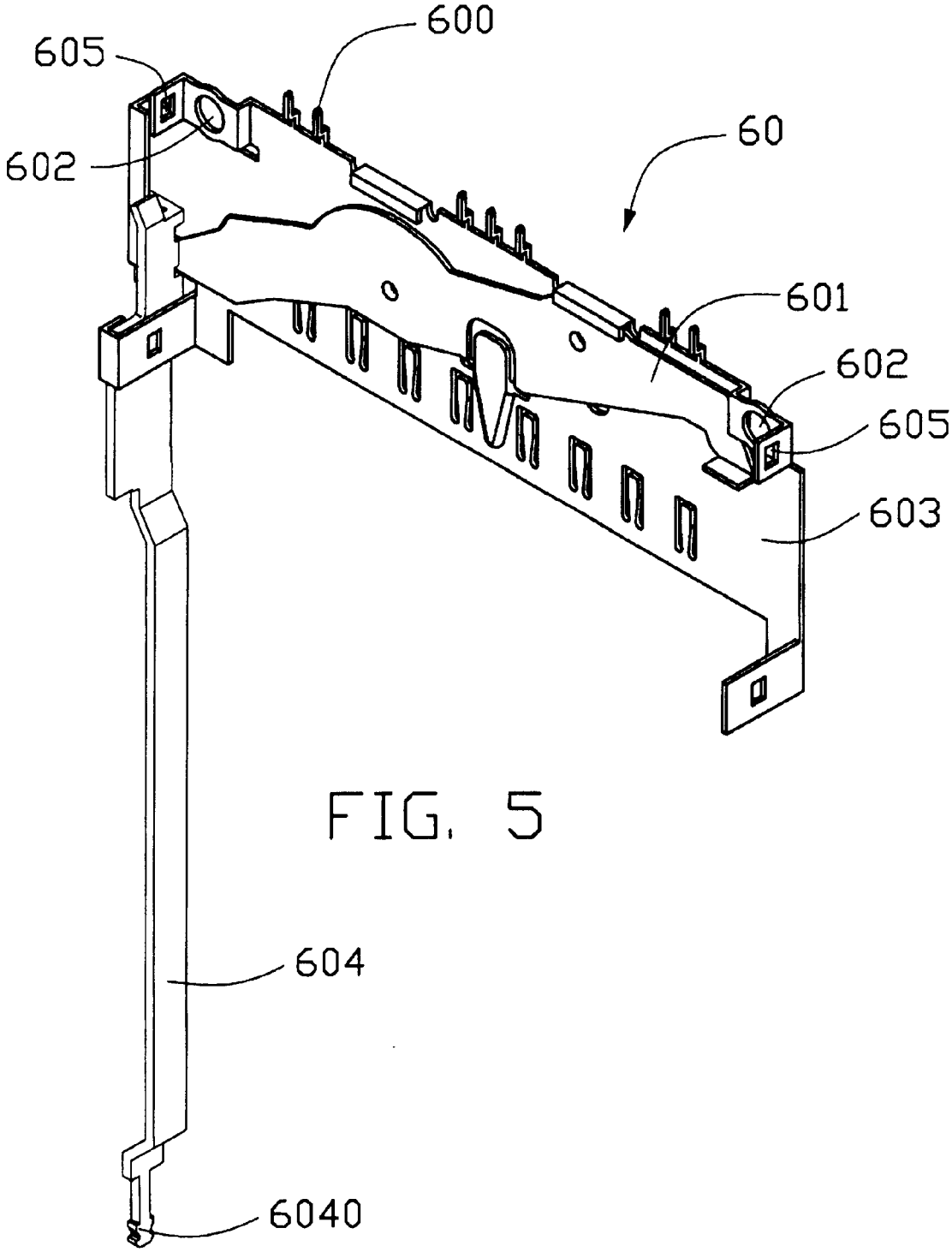
FIG. 5 is a perspective view of an electronic card ejection mechanism of the Card Bus connector.

Also referring to FIGS. 3, 4 and 6, in the embodiment illustrated, the second electronic card connector 3 is a Card Bus connector comprising an insulative header 30 comprising a body 300 retaining a number of second conductive contacts 301 each having portions (not labeled) extending beyond the header body 30 in opposite sides of the header body 30. A surface (not labeled) of the body 300 is stacked on the first electronic card connector 2 and partly the insulative frame 22 of the retention housing 20 for interposing the first electronic card connector 2 between the frame 22 and the second electronic card connector 3. Two latches 3001 are formed on and extending from the surface of the body 300. The latches 3001 extend into and engage with the slots 5001 defined in the first housing 50 to secure the second electronic card connector 3 to the first electronic card connector 2 as shown in FIG. 5. If desired, recesses 25 (FIG. 8) can be formed in the steps 23 of the frame 22 of the first electronic card connector 2, corresponding to and aligned with the slots 5001 for accommodating the portions of the latches 3001 that extend beyond the first housing 50 of the first electronic card connector 2.

The tail 510 of the first contact 51 of the first electronic card connector 2 and the contacts 301 are soldered to the circuit board 4 that abuts against two projections 3005 of the header body 300, as shown in FIG. 6. Holes 3002 are defined in the projections 3005 and in registration with the bores 2000 of the retention housing 20 for the extension of the bolts 80.

Two arms 3006 extend from opposite ends of the header body 300 in a direction opposite to the projections 3005. Guider 3003 is formed on each arm 3006 for guiding an electronic card (not shown) of the Card Bus connector 3 in and out of the connector 3.

Also referring to FIG. 5, a second ejection mechanism 60 is attached to the header body 300 and the arms 3006 of the second electronic card connector 3 for removing the electronic card (not shown) out of the second electronic card connector 3. The second ejection mechanism 60 comprises a top plate 603 defining notches 605 engaging with projections 3004 formed on opposite side faces (not labeled) of the header 30 for being attached to the header body 300 and substantially opposite to the latches 3001. The top plate 603 defines holes 602 in registration with the holes 3002 of the header body 300 for the extension of the bolts 80. The bolts 80 extend, in sequence, through the holes 602 of the top plate 603, the holes 3002 of the header body 300, the bores 2000 of the retention housing 20 and the holes 612 of the bottom plate 61 to secure the second ejection mechanism 61, the second electronic card connector 3, the first electronic card connector 2 and the first ejection mechanism 6 together, as shown in FIGS. 1 and 13.

The top plate 603 is preferably made of a conductive material, such as metal and forms pins 600 soldered to the circuit board 4 for grounding purposes. In this regard, the top plate 603 is sized to substantially cover the second contacts 301 for electromagnetic interference protection.

A second rocking arm 601 is rotatably mounted to the top plate 603 and is drivingly coupled to a second ejection bar 604. The second ejection bar 604 is manually movable with respect to the header 30 for operating the second rocking arm 601 to eject the electronic card out of the second electronic card connector 3.

Figure 11:
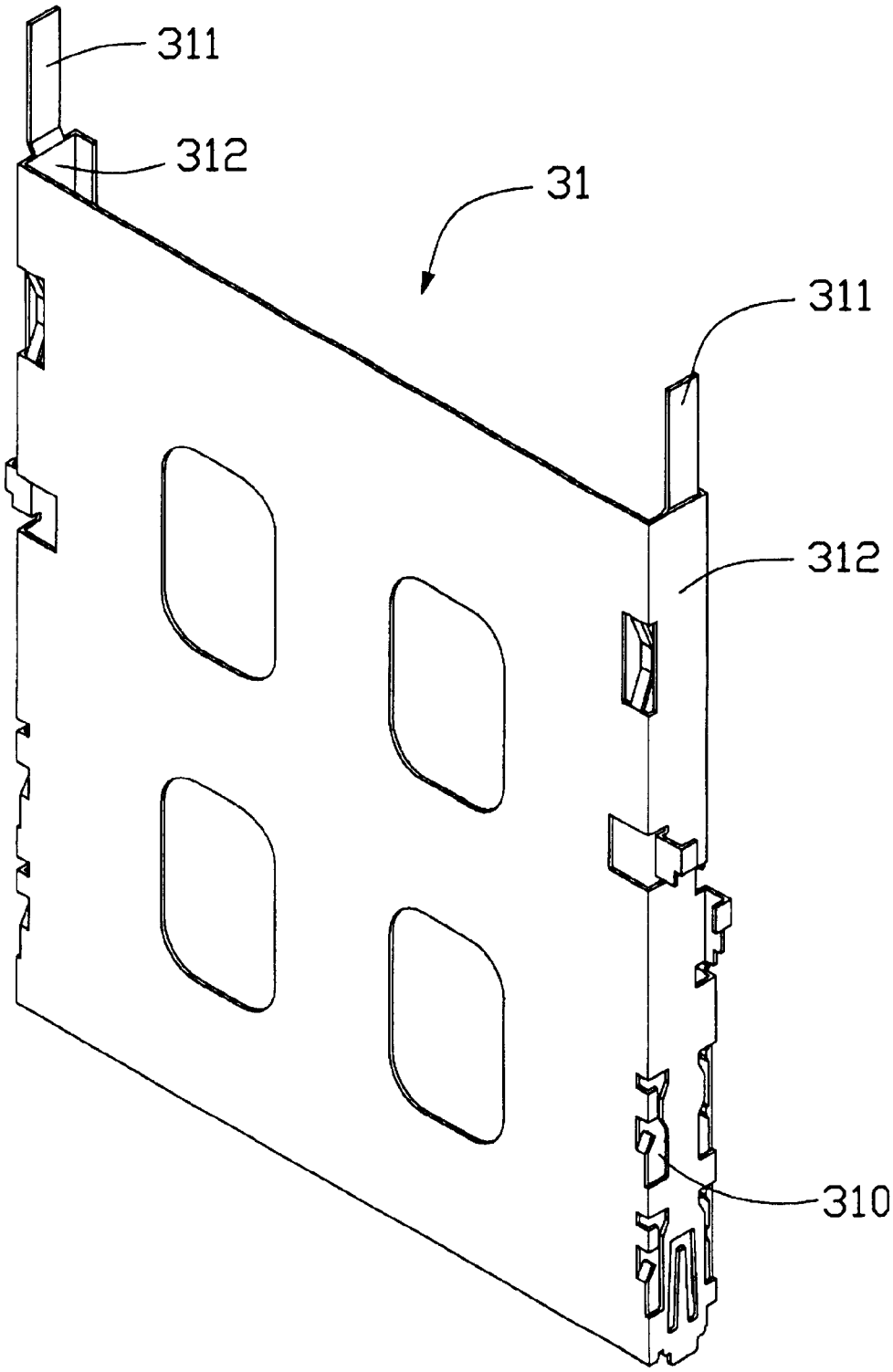
FIG. 11 is a perspective view of the outer shielding shell of the Card Bus connector.

Also referring to FIG. 11, a second, outer shielding shell 31 is attached to and supported by the inner shielding shell 21 for accommodating the electronic card received in the second electronic card connector 3. The outer a shielding shell 31 is provided with extensions 311 received in slits (not labeled) defined in the header body 300 of the header 30. Other known securing means may also be employed to secure the parts of the connector assembly together. Details are not needed herein.

Figure 12:
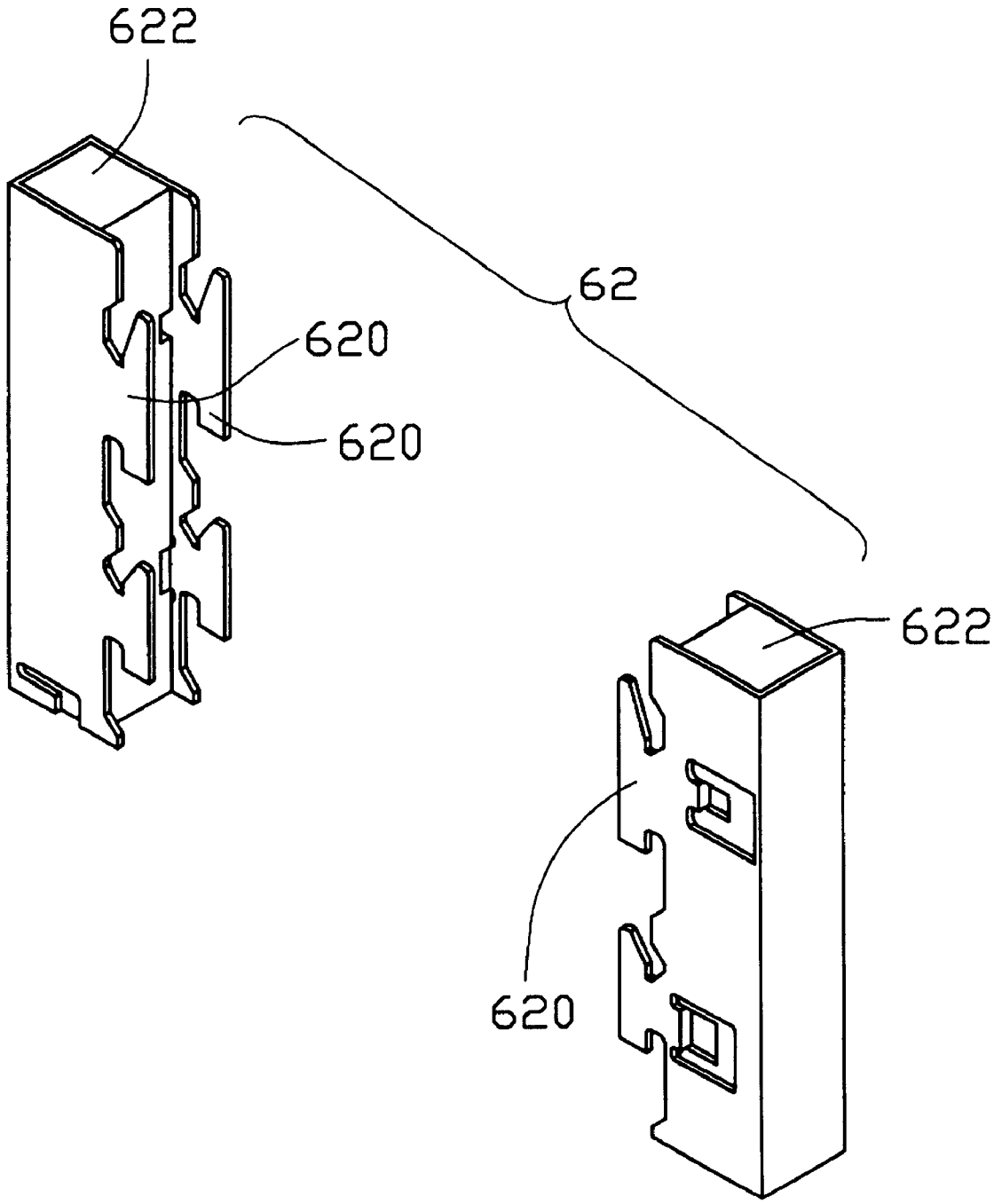
FIG. 12 is a perspective view showing ejection bar retainers of the card ejection mechanisms of the stacked electronic card connector assembly of the present invention.

Also referring to FIG. 12, the outer shielding shell 31 defines slits 310 on each side wall 312 thereof. An ejection bar retaining device 62 comprises two retainer blocks 622 each having protruding tabs 620 engaging with the slits 312 to attach the retainer blocks 622 to the side walls 312 of the outer shielding shell 31. The first and second ejection bars 613, 604 are movably retained between the retainer blocks 622 and the side walls 310 of the outer shielding shell 31. Each ejection bar 613, 604 has a barbed free end 6130, 6040 to which a button 621 is attached for manual access and forcible depression of the ejection bars 613, 604 to eject the electronic cards (not shown) out of the electronic card connectors 2, 3.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. An electronic card connector assembly comprising:

a first electronic card connector, comprising:

a first insulative housing retaining first conductive contacts, each first contact having a tail extending beyond the first housing, a second housing comprising an insulative frame defining an opening in which the first insulative housing is received and retained, the second housing supporting an inner shielding shell and adapted to receive a first electronic card with the first contacts of the first housing electrically engaging the first electronic card, and a first card ejection mechanism coupled to the frame of the second housing and adapted to remove the first electronic card out of the first electronic card connector;

a second electronic card connector adapted to receive a second electronic card, the second electronic card connector comprising:

an insulative header stacked over the first electronic card connector and retaining second conductive contacts adapted to electrically engage the second electronic card, each second contact having a portion extending beyond the header, and a second card ejection mechanism coupled to the header and adapted to remove the second electronic card out of the second electronic card connector; and a connection device comprising a circuit board to which the tails of the first contacts and the portions of the second contacts that extend beyond the header are electrically connected and an additional electrical connector with which the circuit board electrically engages, the additional electrical connector being adapted to be mounted to an external device for electrically connecting the first and second electronic cards received in the first and second electronic card connectors to the external device;

wherein the second electronic card connector comprises an outer shielding shell supported on the inner shielding shell for shielding and accommodating the second electronic card;

wherein two arms extend from opposite ends of the header;

wherein two latches are formed on the header of the second electronic card connector, two slots being defined in the first housing of the first electronic card connector for engaging the latches thereby attaching the first housing to the header;

wherein the opening of the frame of the first electronic card connector is defined by opposite side walls, each side wall forming a step, the first housing forming flanges along opposite sides thereof for being positioned on and supported by the steps of the frame;

wherein at least one cylindrical projection is formed on each flange of the first housing for being fit into a corresponding hole defined in the corresponding step of the frame;

wherein the first housing defines a recess for engaging with a tab extending from the inner shielding shell;

wherein the first card ejection mechanism comprises a bottom plate underlapping the frame of the second housing of the first electronic card connector and shielding the first contacts, the second card ejection mechanism comprising a top plate overlapping the header of the second electronic card connector and shielding the second contacts, grounding pins extending from the top plate and electrically connected to the circuit board;

wherein the top plate, the header, the frame of the second housing and the bottom plate define aligned holes with a bolt extending therethrough to secure the second card ejection mechanism, the second electronic card connector, the first electronic card connector and the first card ejection mechanism together;

wherein the bottom and top plates define notches engaging with projections formed on side faces of the second housing of the first electronic card connector and the header of the second electronic card connector;

wherein the inner shielding shell defines notches engaging with projections formed on side faces of the second housing of the first electronic card connector;

wherein the outer shielding shell forms extensions fit into slits defined in the header for attaching the outer shielding shell to the header;

wherein the first electronic card connector is a Smart Card connector;

wherein the second electronic card connector is a Card Bus connector;

wherein the first card ejection mechanism comprises a rocking arm rotatably supported by the bottom plate and an ejection bar having a first end coupled to the rocking arm for rotating the rocking arm to drive the first electronic card out of the first electronic card connector;

wherein the second card ejection mechanism comprises a rocking arm rotatably supported by the top plate and an ejection bar having a first end coupled to the rocking arm for rotating the rocking arm to drive the second electronic card out of the second electronic card connector;

wherein each of the first and second card ejection mechanisms comprises a manually operable ejection bar located on opposite sides of the electronic card connector assembly; wherein each ejection bar is slidably guided by a retainer block attached to the outer shielding shell supported on the inner shielding shell.

* * * * *